US005438391A

United States Patent [19]

Maekawa et al.

[11] Patent Number: 5,438,391

[45] Date of Patent: Aug. 1, 1995

[54] CLAMSHELL-TYPE IMAGE FORMING APPARATUS

[75] Inventors: Takashi Maekawa, Kawasaki; Akira Takahashi, Fukushima, both of Japan

[73] Assignees: Fujitsu Limited, Kawasaki; Fujitsu Isotec Limited, Inagi, both of Japan

[21] Appl. No.: 103,787

[22] Filed: Aug. 10, 1993

[30] Foreign Application Priority Data

Sep. 28, 1992 [JP] Japan ..... 4-257921

[51] Int. Cl.[6] ..... G03G 21/00

[52] U.S. Cl. ..... 355/200; 355/321

[58] Field of Search ..... 355/200, 210, 321

[56] References Cited

U.S. PATENT DOCUMENTS

| | | | |
|---|---|---|---|
| 4,754,293 | 6/1988 | Aizawa et al. | 355/309 X |
| 5,140,369 | 8/1992 | Haneda et al. | 355/210 |
| 5,141,222 | 8/1992 | Sawada et al. | 271/292 |
| 5,245,357 | 9/1993 | Maruyama et al. | 355/200 X |

*Primary Examiner*—A. T. Grimley
*Assistant Examiner*—Nestor R. Ramirez
*Attorney, Agent, or Firm*—Staas & Halsey

[57] ABSTRACT

There is disclosed an image forming apparatus which facilitates exchange of a process cartridge for forming an image and which can allow a large exchangeable process cartridge to be used. This image forming apparatus consists of an endless latent image carrier; a unit for forming an electrostatic latent image on the latent image carrier; a developing unit for developing the electrostatic latent image on the latent image carrier; a unit for transferring a toner image on the latent image carrier onto a sheet; a unit for fixing the toner image on the sheet; a unit for retaining the sheet; a process cartridge, provided detachable to the apparatus above the sheet retaining unit, for holding at least the latent image carrier and the developing unit; a stacker, provided above the process cartridge, for holding a discharged sheet; a feeding path along which the sheet from the sheet retaining unit is discharged on the stacker through the process cartridge; a front cover provided on the housing to be rotatable frontward of the apparatus; an upper cover provided on the housing to be rotatable upward of the apparatus, the stacker being formed in the upper cover, wherein the first cover is provided in such way that a distal end of the front cover covers that of the upper cover, a first discharge roller provided at the distal end of the front cover, a second discharge roller provided as the distal end of the upper cover, facing the first discharge roller, a movable support block provided on the upper cover, for supporting the second discharge roller, a positioning manner provided on the front cover and engageable with the support block, and wherein the support block has a sub-support block for supporting a shaft of the second discharge roller and a spring member for urging the sub-support block toward the front discharge roller.

21 Claims, 12 Drawing Sheets

CLAMSHELL-TYPE IMAGE FORMING APPARATUS

BACKGROUND OF THE INVENTION

1. Field of the Invention

The present invention relates to an image forming apparatus which acquires a toner image by developing an electrostatic latent image formed on a latent image carrier such as a photosensitive drum and then transfers the toner image on a sheet of paper. More particularly, this invention relates to an image forming apparatus in which a process unit for forming an image is constituted as an exchangeable cartridge.

2. Description of the Related Art

Image forming apparatus, such as a copying machine, a printer and a facsimile machine, employ a latent image forming type recording apparatus like an electrophotographing apparatus, due to a recent demand for image recording on normal sheets of paper. According to this image forming principle, after a photosensitive drum as a latent image carrier is precharged, the photosensitive drum is exposed to a light image to have an electrostatic latent image formed thereon. This electrostatic latent image is developed by a developing unit so that a toner image is formed on the photosensitive drum. This toner image is then transferred onto a sheet of paper.

The image forming process unit should be exchanged with a new one since the photosensitive drum has a limited service life and the developer in the developing unit will eventually run out. To facilitate the exchanging operation, the photosensitive drum, the developing unit, etc. are installed in a single cartridge so that they can be handled cartridge by cartridge.

There is a demand for a more compact image forming apparatus incorporating such a process cartridge. There is also a demand for a process cartridge which has a longer service life and is easy to exchange.

FIGS. 1A and 1B are explanatory diagrams of prior art. As shown in FIG. 1A, the image forming apparatus has a process cartridge 160 provided above a sheet cassette 170 for retaining sheets of paper, and a stacker 173 disposed above this process cartridge 160. A U-shaped feeding path 171, which extends from the sheet cassette 170 and reaches the stacker 173 through the process cartridge 160, is formed so that sheets are conveyed along this path 171. This arrangement can prevent the sheet cassette 170 from protruding from the apparatus, thus making it possible to design the apparatus compact. Further, the sheet feeding path 171 can be made short, allowing the apparatus to become more compact. As the feeding path 171 runs vertically, it is easy to remove a jammed sheet.

The process cartridge 160, which is provided in the thus constituted image forming apparatus, has a photosensitive drum 161, a precharger for precharging the photosensitive drum 161, a developing unit for developing an electrostatic latent image on the photosensitive drum 161 with a toner, and a cleaner for removing and collecting the residue toner on the photosensitive drum 161. This process cartridge 160 is exchangeable cartridge by cartridge. Provided at the rear portion of the process cartridge 160 is an optical unit 163 for exposing the photosensitive drum 161 to a laser beam to form an electrostatic latent image thereon. A transfer roller 162 is disposed opposite the photosensitive drum 161, and discharge rollers 172 are provided on the discharge side of the U-shaped feeding path 171.

A rotatable front cover 180 is provided at the front of the image forming apparatus. As shown in FIG. 1B, this front cover 180 is opened to allow the user to remove a jammed sheet. With the front cover 180 open, the process cartridge 160 can be pulled out so that it can be exchanged with a new process cartridge 160. This method is advantageous because the sheet cassette 170 can be loaded or unloaded from the front side of the apparatus (on the right-hand side of the drawing), and the removal of a jammed sheet and the exchanging of the process cartridge 160 become possible when the front cover 180 is opened.

As the apparatus becomes compact, the front cover 180 cannot have a large open angle. To exchange the process cartridge 160, therefore, the process cartridge 160 should be lifted up obliquely as shown in FIG. 1B, making the exchanging operation troublesome. As the open angle of the front cover 180 is small, exchange is difficult unless the process cartridge 160 is made smaller. Naturally, individual process units of the process cartridge 160 should become smaller. As a result, the amount of the retainable developer may become smaller, reducing the maximum number of prints allowable by a single process cartridge 160 and thus resulting a shorter exchanging cycle. Further, if the developer runs out, the process cartridge itself should be exchanged, so that the other process units should be exchanged at the same time before their service lives actually expire. This way, resources are wasted and the process cartridge 160 should be exchanged frequently.

SUMMARY OF THE INVENTION

It is therefore a primary object of the present invention to provide an image forming apparatus designed to facilitate exchange of process cartridges.

It is another object of the present invention to provide an image forming apparatus which, even if made compact, can result in the service life of the process cartridge lasting longer.

It is a further object of the present invention to provide an image forming apparatus which can use a relative large process cartridge with a long service life.

It is a still further object of the present invention to provide an image forming apparatus which can facilitate removal of a jammed sheet.

To achieve the foregoing and other objects and in accordance with the purpose of the present invention, an image forming apparatus according to this invention comprises an endless latent image carrier; image forming means for forming an electrostatic latent image on the latent image carrier; developing means for developing the electrostatic latent image on the latent image carrier; transfer means for transferring a toner image on the latent image carrier onto a sheet; fixing means for fixing the toner image on the sheet; sheet retaining means, provided at the bottom portion of a housing of the apparatus, for retaining the sheet; a process cartridge, provided detachable to the apparatus above the sheet retaining means, for holding at least the latent image carrier and the developing means; a stacker, provided above the process cartridge, for holding a discharged sheet on which the toner image has been fixed; a feeding path along which the sheet from the sheet retaining means is discharged on the stacker through the process cartridge; a front cover provided on the housing to be rotatable frontward of the apparatus; and an upper cover provided on the housing to be rotatable upward of the apparatus, the stacker being formed in the upper cover.

With the above structure, as the front of the apparatus is opened by the front cover and the area above the process cartridge is opened by the upper cover, the opened space can be increased. It is therefore possible to also pull out the process cartridge upward of the apparatus, thus facilitating the exchange of the process cartridge. Further, as large opened space can be provided, the exchangeable process cartridge can be designed larger, so that the amount of the retainable developer can be increased and the exchanging cycle can be extended.

Other features and advantages of the present invention will become readily apparent from the following description taken in conjunction with the accompanying drawings.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENT

Figure 1A:
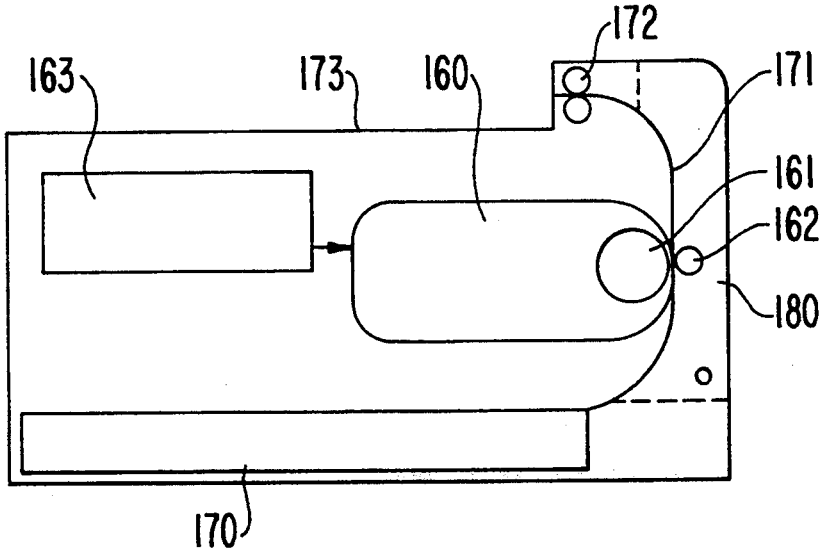
FIG. 1A (PRIOR ART)
FIGS. 1A and 1B are explanatory diagrams of prior art.
Figure 1B:
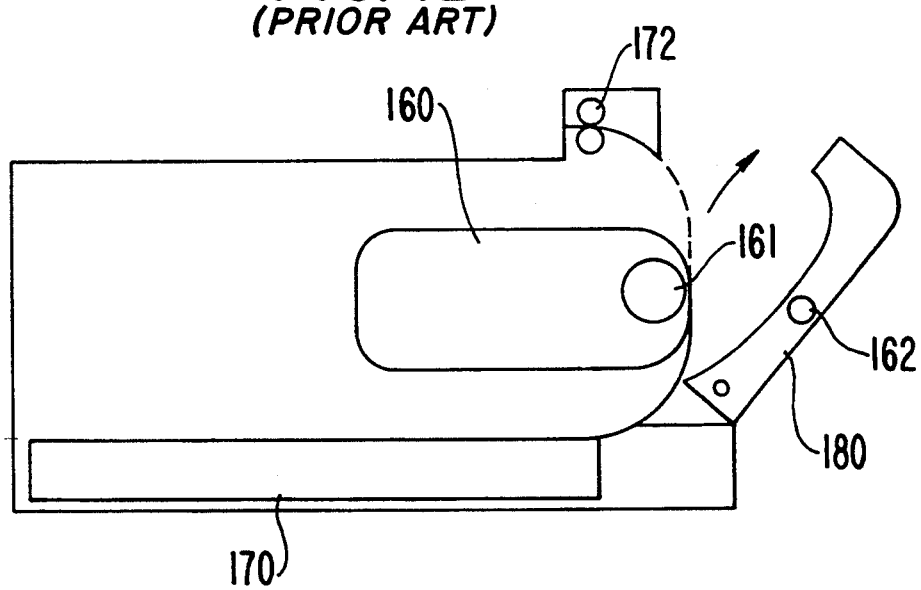
FIG. 1B (PRIOR ART)
Figure 2:
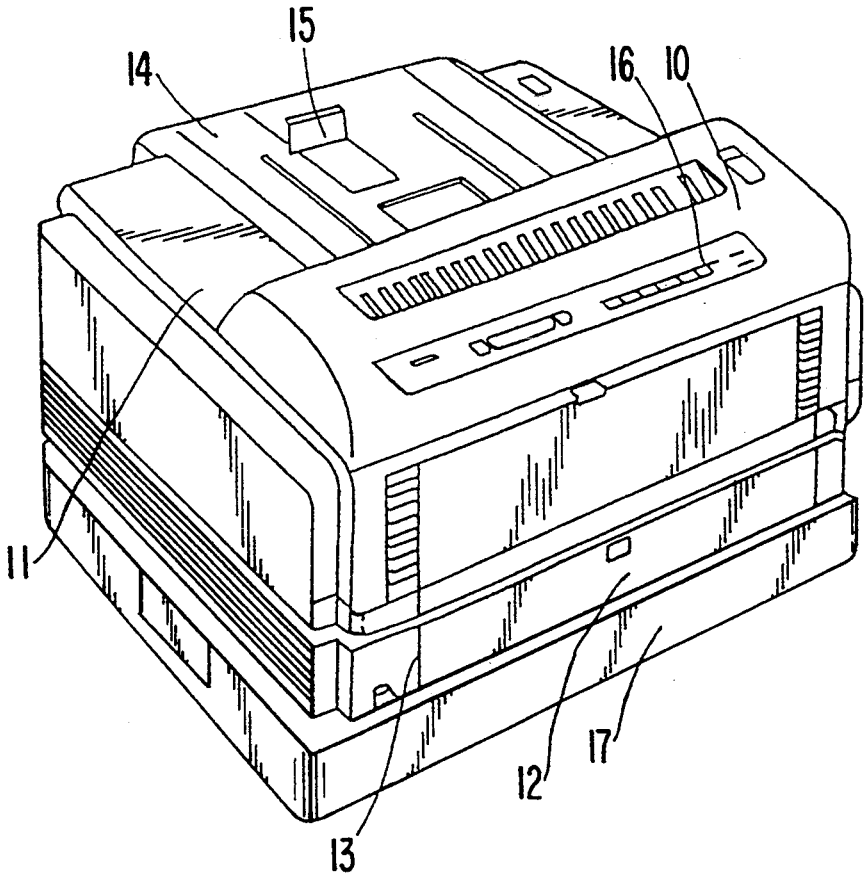
FIG. 2 is a perspective view showing the outline of an image forming apparatus according to one embodiment of the present invention.
Figure 3:
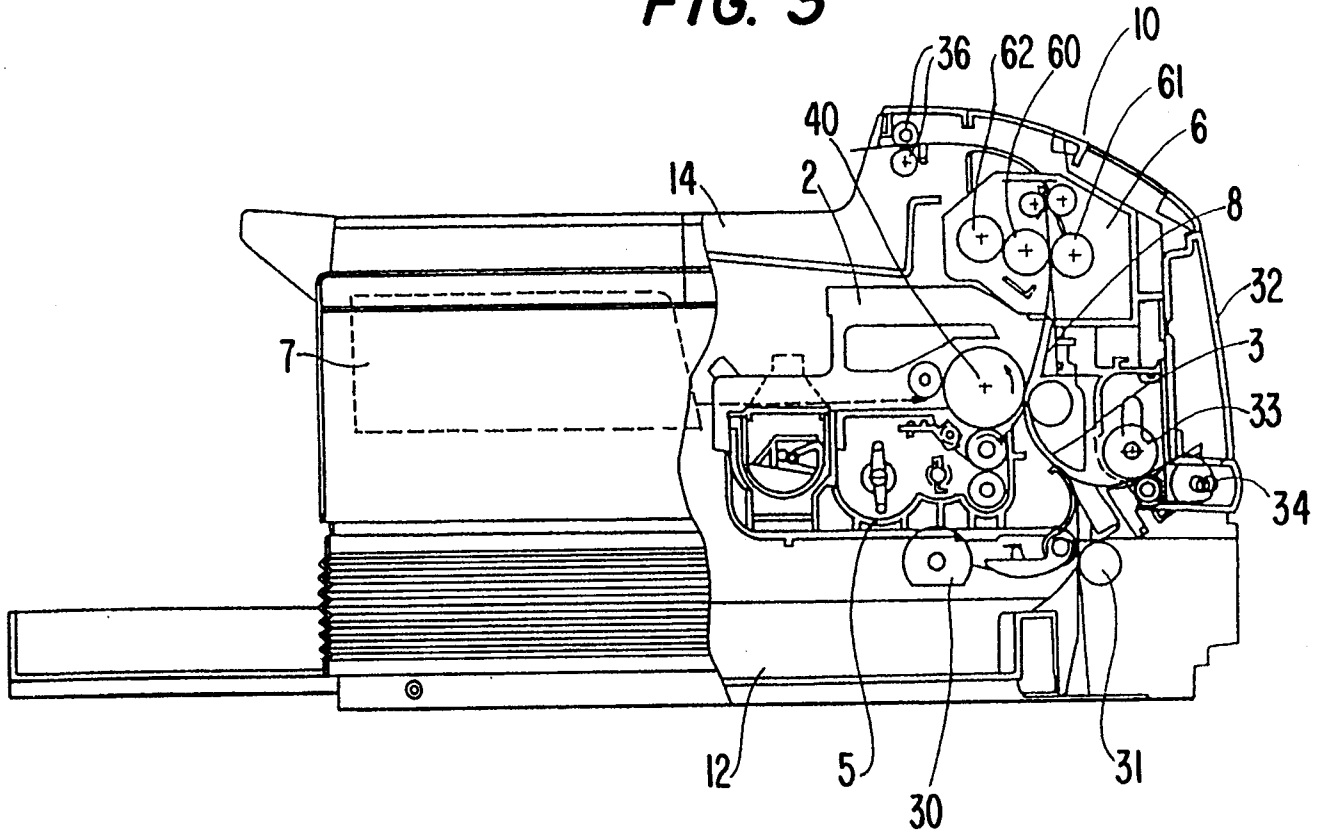
FIG. 3 is a cross-sectional view showing the interior of the image forming apparatus shown in FIG. 2.
Figure 4:
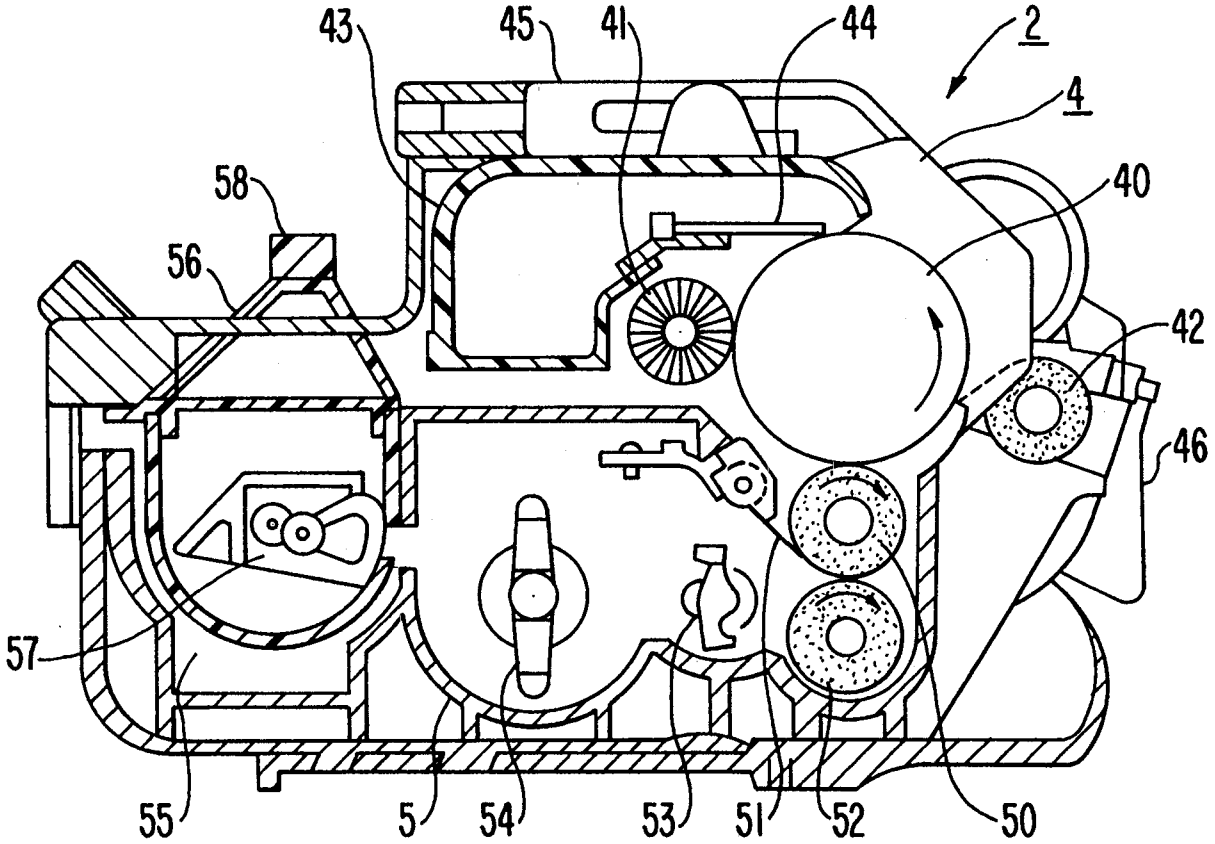
FIG. 4 is a cross section of a process cartridge of the image forming apparatus shown in FIG. 2.
Figure 5A:
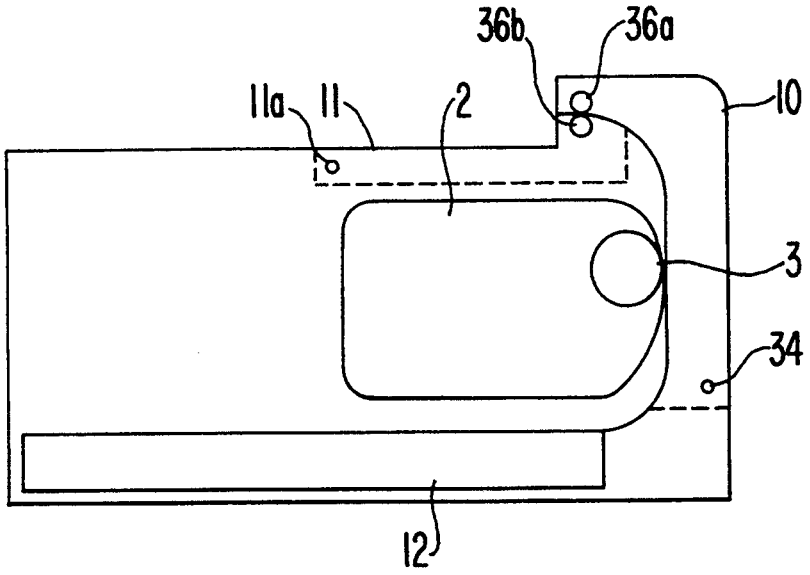
FIGS. 5A and 5B are diagrams for explaining the function of the covers of the image forming apparatus in FIG. 2.
Figure 5B:
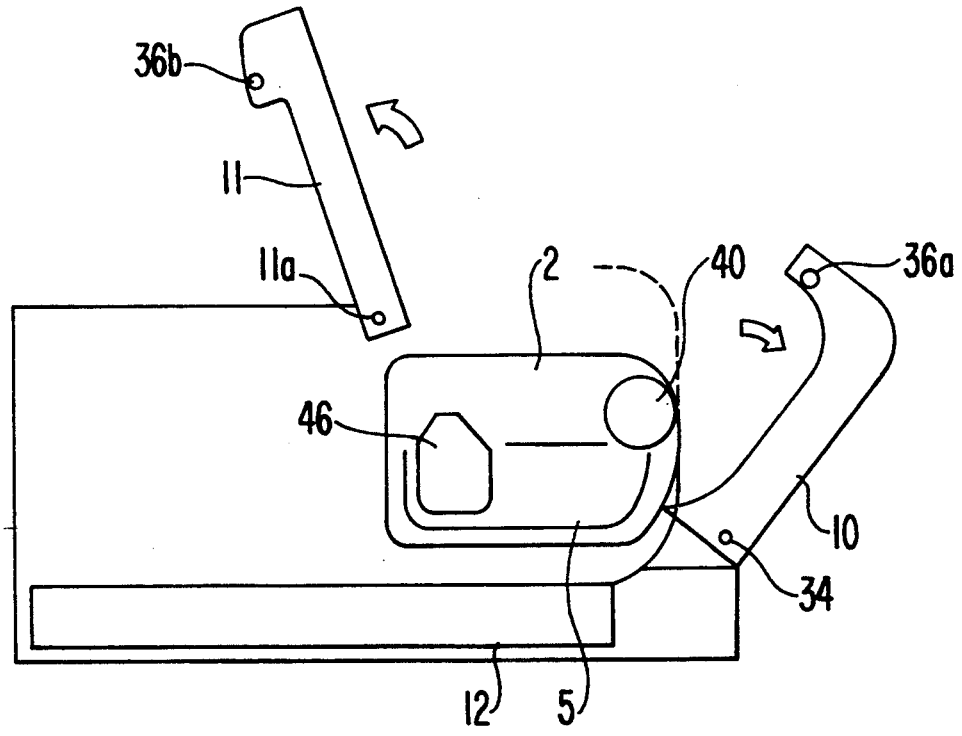
Figure 6:
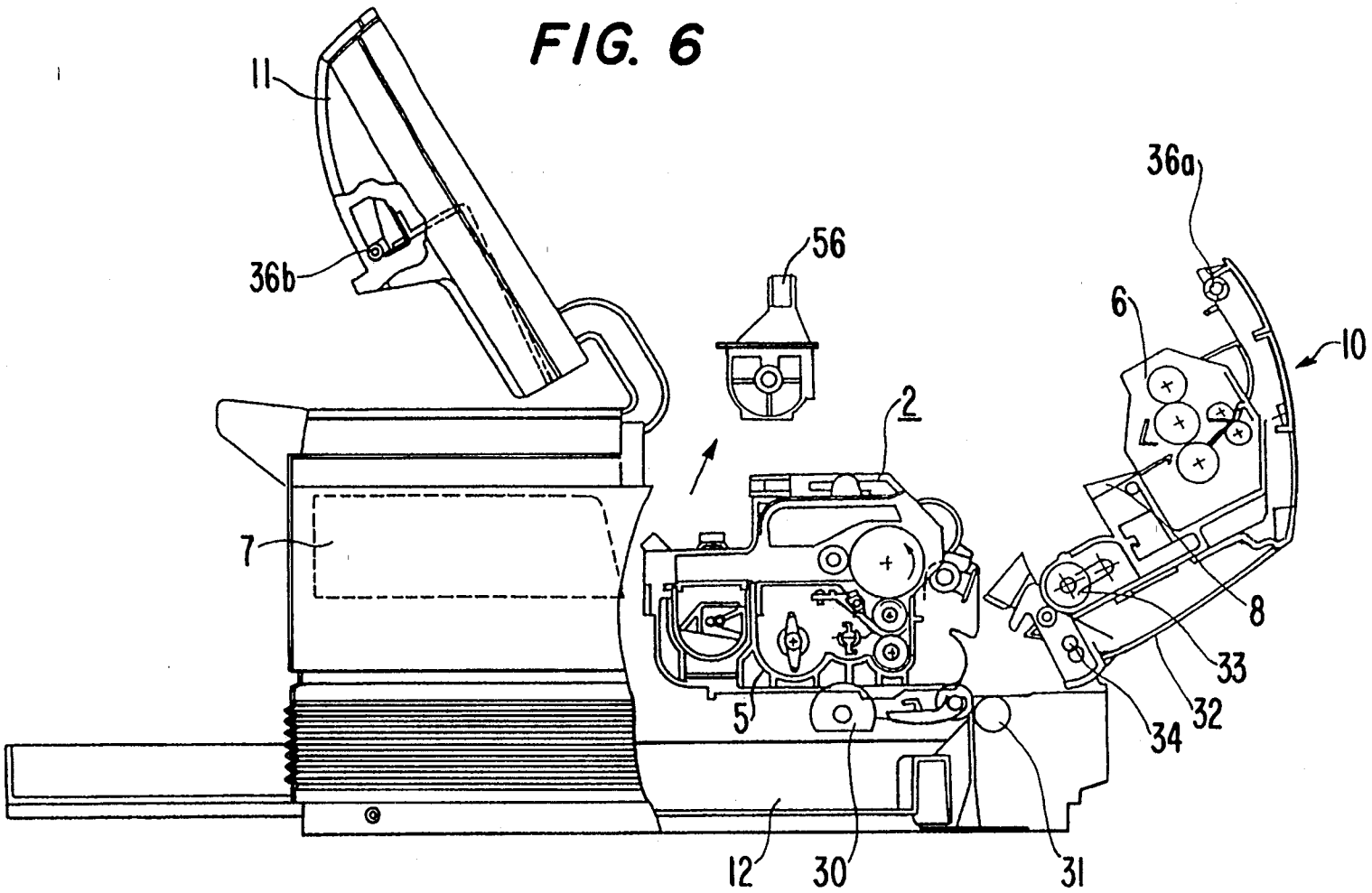
FIG. 6 is an elevational view illustrating the image forming apparatus with its covers open.
Figure 7A:
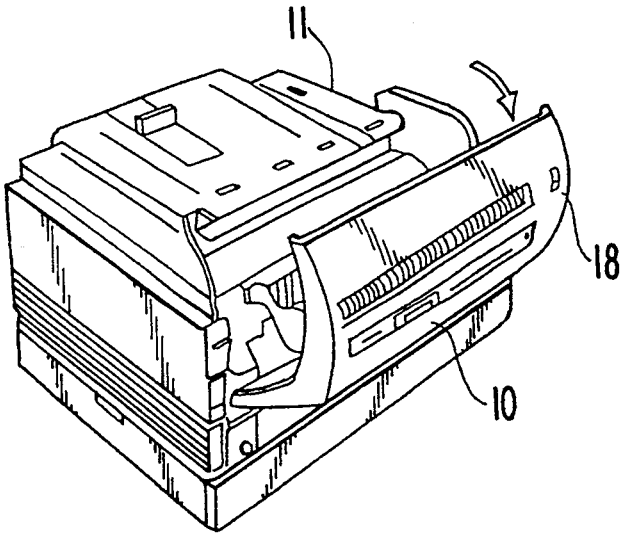
FIGS. 7A and 7B are perspective view for explaining the order of opening the covers of the image forming apparatus shown in FIG. 1.
Figure 7B:
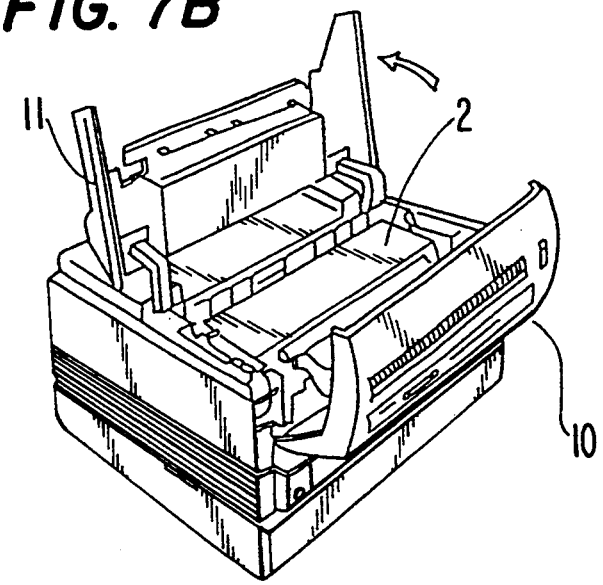
Figure 8:
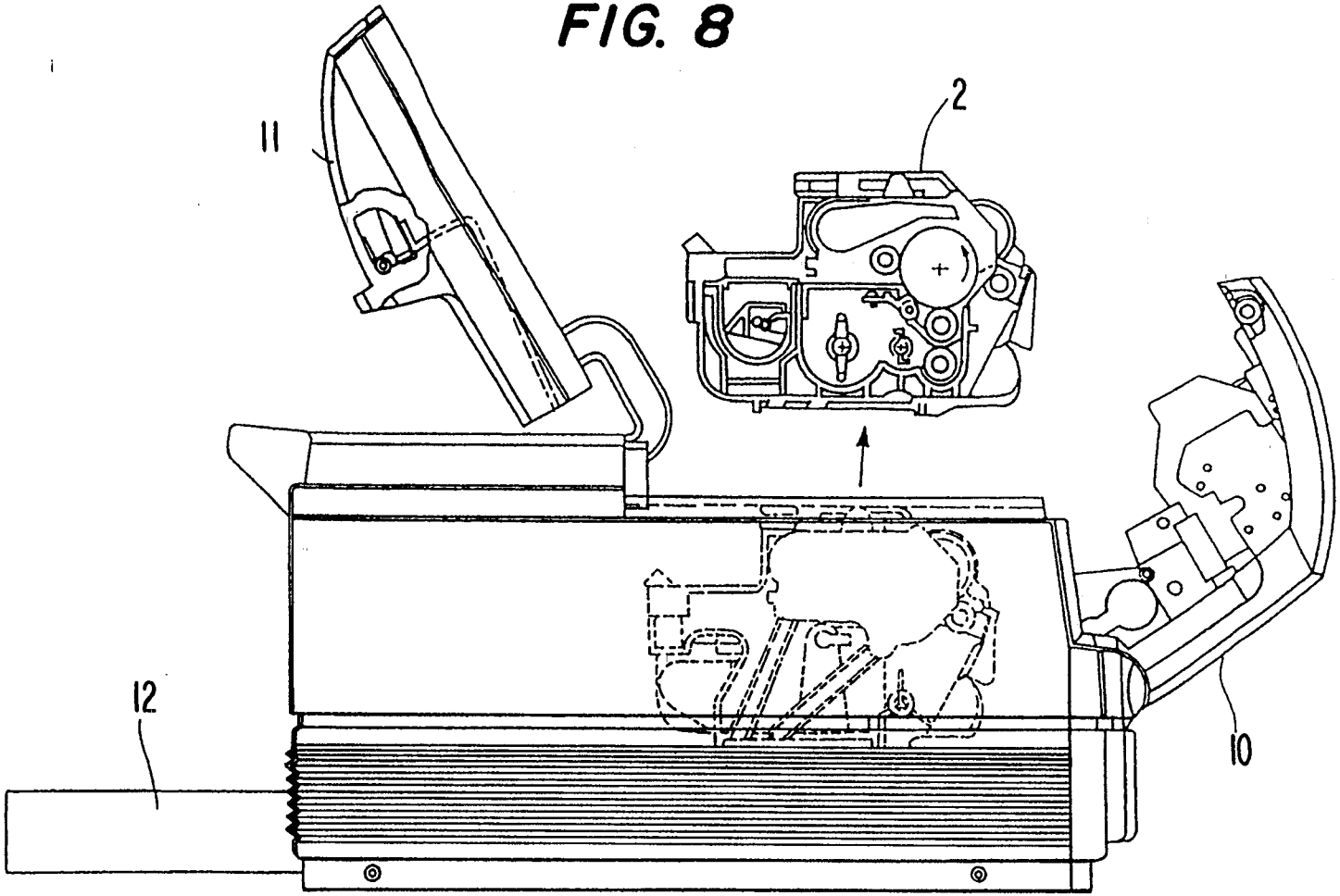
FIG. 8 is an elevational view for explaining how to exchange the process cartridge of the image forming apparatus shown in FIG. 2.

FIG. 2 is a perspective view showing the outline of an image forming apparatus according to one embodiment of the present invention, FIG. 3 is a cross-sectional view showing the interior of the image forming apparatus shown in FIG. 2, FIG. 4 is a cross section of a process cartridge shown in FIG. 3, FIG. 5A illustrates the covers of the image forming apparatus in FIG. 2 closed, FIG. 5B illustrates the covers of the image forming apparatus in open position, FIG. 6 is a diagram explaining the exchanging of a toner cassette with the covers open as in FIG. 5B, FIG. 7A is a perspective view of the image forming apparatus with its front cover open, FIG. 7B is a perspective view of the image forming apparatus with its upper cover open, and FIG. 8 illustrates the image forming apparatus with both the front and upper covers open.

The illustrated image forming apparatus of FIG. 2 is an electrophotographic printer. A front cover 10 is opened frontward of the apparatus to open a feeding path 3 shown in FIG. 3. An upper cover 11 covers the top of the apparatus, and is opened upwardly of the apparatus. When opened, the upper cover 11 opens the top of the apparatus. A sheet cassette 12 is to be set in the apparatus from the front thereof through a cassette inserting port 13. A stacker 14 is provided on the upper cover 11 at the top of the apparatus to receive printed sheets. A sheet guide 15 is provided on the stacker 14 to guide the sheet discharged on the stacker. An operation panel 16 is provided at a front cover 10 and has various switches and a display section. A controller box 17 is provided at the bottom of the apparatus and accommodates printer control circuits, etc.

Referring to the cross-sectional view in FIG. 3, an electrophotographic process cartridge 2 is provided above the sheet cassette 12 and will be described later with reference to FIG. 4. A thermal fixing unit 6 causes a sheet to be put through between a heat roller 60 and a backup roller 61 to fix a toner image on that sheet. This thermal fixing unit 6 is provided with a cleaning roller 62 for removing a toner from the heat roller 60. An optical unit 7 uses a polygon mirror to scan the photosensitive drum 40 with a beam from a semiconductor laser, which is driven according to image information, thereby writing an image on the photosensitive drum 40. The light image from the optical unit 7 passes above a developing unit 5 (which will be described referring to FIG. 4) of the process cartridge 2 as indicated by a broken-lined arrow to irradiate the photosensitive drum 40 of the process cartridge 2. A sheet separator 8 has a discharge electrode to apply charges of the opposite polarity to that of the potential at the back of the sheet on which the toner image on the photosensitive drum 40 has been transferred, to that back of the sheet to deelectrify the back of the sheet, thereby separating the sheet from the photosensitive drum 40.

A pickup roller 30 serves to pick up sheets in the sheet cassette 12. A resist roller 31 aligns the leading edge of the sheet picked up by the pickup roller 30, and feeds out the sheet. Reference numeral "32" denotes a manual-inserting guide which guides a manually inserted sheet to a feeding roller 33 when opened rightward in FIG. 3. The feeding roller 33 feeds the sheet, guided by the manual-inserting guide 32, toward the photosensitive drum 40 of the process cartridge 2. Reference numeral "34" is the rotary shaft of the front cover 10. Discharge rollers 36 are provided at the top portion of the thermal fixing unit 6 to discharge the sheet, passing through the thermal fixing unit 6, onto the stacker 14.

In this embodiment, a U-shaped feeding path is formed, which extends from the sheet cassette 12 and reaches the discharge rollers 36 through the resist roller 31, the photosensitive drum 40 of the process cartridge 2 and the thermal fixing unit 6.

As shown in the cross-section view in FIG. 4, the process cartridge 2 comprises a drum cartridge 4 and the developing unit 5. The developing unit 5 is attached to the drum cartridge 4 by pins (not shown), and can be separated therefrom by detaching the pins.

The structure of the drum cartridge 4 will now be described. In FIG. 4, the photosensitive drum 40 has an organic photosensitive layer (OPC or the like) formed on the surface of a cylindrical base of aluminum or the like, and is rotatable counterclockwise as shown. A brush charger 41 is constituted by winding a conductive brush, which has conductive rayon fibers woven into the core, around the rotary shaft. The photosensitive drum 40 is uniformly charged to about −600 V by this brush charger 41. A transfer roller 42 is provided at the drum cartridge 4, and is made of a conductive porous rubber material, such as porous polyurethane foam (sponge). This transfer roller 42 is applied with a transfer voltage and is pressed against the photosensitive drum 40 to transfer the toner image on the photosensitive drum 40 onto the sheet. A waste toner box 43 is provided with a scraping blade 44, which scrapes the residue toner off the photosensitive drum 40, so that the box 43 receives the scraped toner. A handle 45 is provided to permit a user to carrying the drum cartridge 4 with a hand. A roller cover 46 serves to hold and protect the transfer roller 42.

The structure of the developing unit 5 will be described next. Referring to FIG. 4, a developing roller 50 is a conductive elastic roller, which is preferably made of a conductive porous rubber material, such as conductive porous polyurethane foam (sponge). The developing roller 50 rotates clockwise as shown in the diagram to feed a non-magnetic, one-component toner to the photosensitive drum 40 while holding the toner with the retentive force of its surface. This developing roller 50 is pressed against the photosensitive drum 50 with a predetermined nip width and is applied with a developing bias voltage of about −300 V. A layer-thickness restricting blade 51, which is made of a 0.1-mm thick stainless plate, serves to restrict the thickness of the toner layer on the developing roller 50 to a predetermined thickness. This layer-thickness restricting blade 51 is pressed against the developing roller 50 and is applied with a negative voltage of about −400 V. This applied voltage allows the layer-thickness restricting blade 51 to supply negative charges to the toner to forcibly charge the toner negatively at the time of restricting the thickness of the toner layer. Accordingly, the toner can be charged stably even under conditions of high humidity and high temperature. A reset roller 52 is disposed to face the developing roller 50 and rotates in the same direction as the developing roller 50. This reset roller 52 is applied with a bias voltage of −400 V to scrape the toner off the developing roller 50 in the right-hand side of the diagram and supply the toner to the developing roller 50 in the left-hand side of the diagram.

Reference numerals "53" and "54" denote paddle rollers, which rotate to stir the non-magnetic, one-component toner in the developing unit 5 and charge the toner. In addition, the paddle rollers 53 and 54 supply the stirred toner toward the reset roller 52. A toner cassette retainer 55 retains a toner cassette 56, which contains the non-magnetic, one-component toner. This toner cassette 56 is detachable to the toner cassette retainer 55. A toner supply lever 57 is provided in the toner cassette 56, and rotates to supply the toner in the toner cassette 56 into the developing unit 5. The toner cassette 56 is provided with a handle 58 to allow a user to hold the toner cassette 56 with a hand. Sheet guide ribs 59 are provided below the roller cover 46. The sheet guide ribs 59, together with the roller cover 46, form a path for guiding the sheet between the photosensitive drum 40 and the transfer roller 42.

The function of this printer will be described referring to FIGS. 2 through 4. A sheet in the sheet cassette 12 is picked up by the pickup roller 30 and abuts against the resist roller 31. After the leading edge is aligned by the resist roller 31, this sheet is fed toward the photosensitive drum 40 along a U-shaped feeding path 3. Meantime, when the picked sheet reaches the resist roller 31, the optical unit 7 starts exposing the photosensitive drum 40 to image light. As a result, the potential of the image-exposed portion of the photosensitive drum 40, which has been charged to −600 V by the brush charger 41 becomes zero, thus forming an electrostatic latent image corresponding to the image to be copied.

As a bias voltage of −300 V is applied to the developing roller 50 in the developing unit 5, the negatively charged toner sticks on the image-exposed portion of zero potential of the photosensitive drum 40, forming a toner image thereon. The toner image on the photosensitive drum 40 is transferred onto the sheet, fed by the resist roller 31, by the transfer roller 42 due to the electrostatic force and pressure. The back of the sheet that is electrostatically adsorbed to the photosensitive drum 40 is deelectrified by the charges supplied by the sheet separator 8, so that this sheet is separated from the photosensitive drum 40. The separated sheet is fed to the thermal fixing unit 6 where the toner image on the sheet is thermally fixed by the heat roller 60. The image-fixed sheet is then discharged on the stacker 14 by the discharge rollers 36.

A sheet manually inserted through the manual-inserting guide 32 pulled open is likewise conveyed toward the photosensitive drum 40 by the feeding roller 33. The toner image on the photosensitive drum 40 is transferred onto that sheet by the transfer roller 42 due to the electrostatic force and pressure. The back of the sheet that is electrostatically adsorbed to the photosensitive drum 40 is deelectrified by the charges supplied by the sheet separator 8, so that this sheet is separated from the photosensitive drum 40. The separated sheet is then fed to the thermal fixing unit 6 where the toner image on the sheet is thermally fixed by the heat roller 60. The resultant sheet is then discharged on the stacker 14 by the discharge rollers 36.

A description will now be given of the operation of opening the covers 10 and 11 of the apparatus closed as shown in FIG. 5A to the state as shown in FIGS. 5B and 6. The front cover 10 is opened frontward (rightward in FIGS. 5B and 6) around the cover rotary shaft 34 provided on the housing of the apparatus. Provided on this front cover 10 are the manual-inserting guide 32, the feeding roller 33, the sheet separator 8, the thermal fixing unit 6 and an upper discharge (drive) roller **36*a* of the discharge roller pair 36. The upper cover 11 is opened upward of the apparatus (upward in the diagram) around a rotary shaft 11*a* shown in FIG. 5B. A lower discharge (pinch) roller 36*b* of the discharge roller pair 36 is provided on the upper cover 11. With the covers closed as shown in FIG. 5A, the distal end of the front cover 10 is placed over the distal end of the upper cover 11, so that the discharge roller 36*a* of the front cover 10 faces the discharge roller 36*b* of the upper cover 11**.

When the front cover 10 is opened by unlocking a lock lever 18 of the front cover 10, as shown in FIGS.

6 and 7A, the U-shaped feeding path 3 extending from the resist roller 31 to the discharge rollers 36 is opened, making it easier to remove any jammed sheet. If the transfer roller 42 is shifted from the proper position facing the photosensitive drum 40, i.e., if there is a shift in parallelism and position to the photosensitive drum 40, image transfer cannot be executed properly. In this respect, the transfer roller 42 is provided on the process cartridge 2. Although this design does not open the space between the photosensitive drum 40 and the transfer roller 42, a jammed sheet can easily be removed without any problem even if that portion does not become free.

The reason why the whole thermal fixing unit 6 is provided on the front cover 10 is that if the thermal fixing unit 6 were divided to open the feeding path, a part of the thermal fixing unit should be provided on the process cartridge 2, thus inconveniencing a user to remove the process cartridge 2. Although this design does not open the space between the heat roller 60 of the thermal fixing unit 6 and the backup roller 61, a jammed sheet can easily be removed without any problem even if that portion does not become free.

The front cover 10 is provided above the upper cover 11 at the sheet discharging portion so that the upper cover 11 does not become free unless the front cover 10 is opened as shown in FIG. 5A. When the front cover 10 is opened and the upper cover 11 is opened next as shown in FIG. 7B, therefore, the top portion of the apparatus and part of the front portion of the apparatus are opened as shown in FIG. 6. Accordingly, the toner cassette 56 can easily be removed or attached from the front side of the apparatus while keeping the process cartridge 2 installed in the apparatus, thus allowing for the exchange of the toner cassette 56 alone.

As the front side of the apparatus is opened by opening the front cover 10 and the top portion of the apparatus is opened by opening the upper cover 11 as shown in FIG. 8, the attachment and detachment of the process cartridge 2 can also be performed easily. Even if the process cartridge 2 is large, the exchange of the process cartridge 2 is easy. In other words, the process cartridge 2 can be designed large, particularly, the developing unit 5 in the process cartridge-2 can be designed large, so that the quantity of the retainable developer can be increased, thus making the exchanging cycle of the developing unit 5 significantly long.

Further, since the developer can be supplemented through the exchange of the toner cassette 56 alone, the exchanging cycle of the developing unit 5 can be made longer. Furthermore, as the covers 10 and 11 are opened with the discharge rollers 36 separated into upper and lower rollers, the entire U-shaped feeding path 3 can be opened, thus facilitating removal of a jammed sheet.

Figure 9:
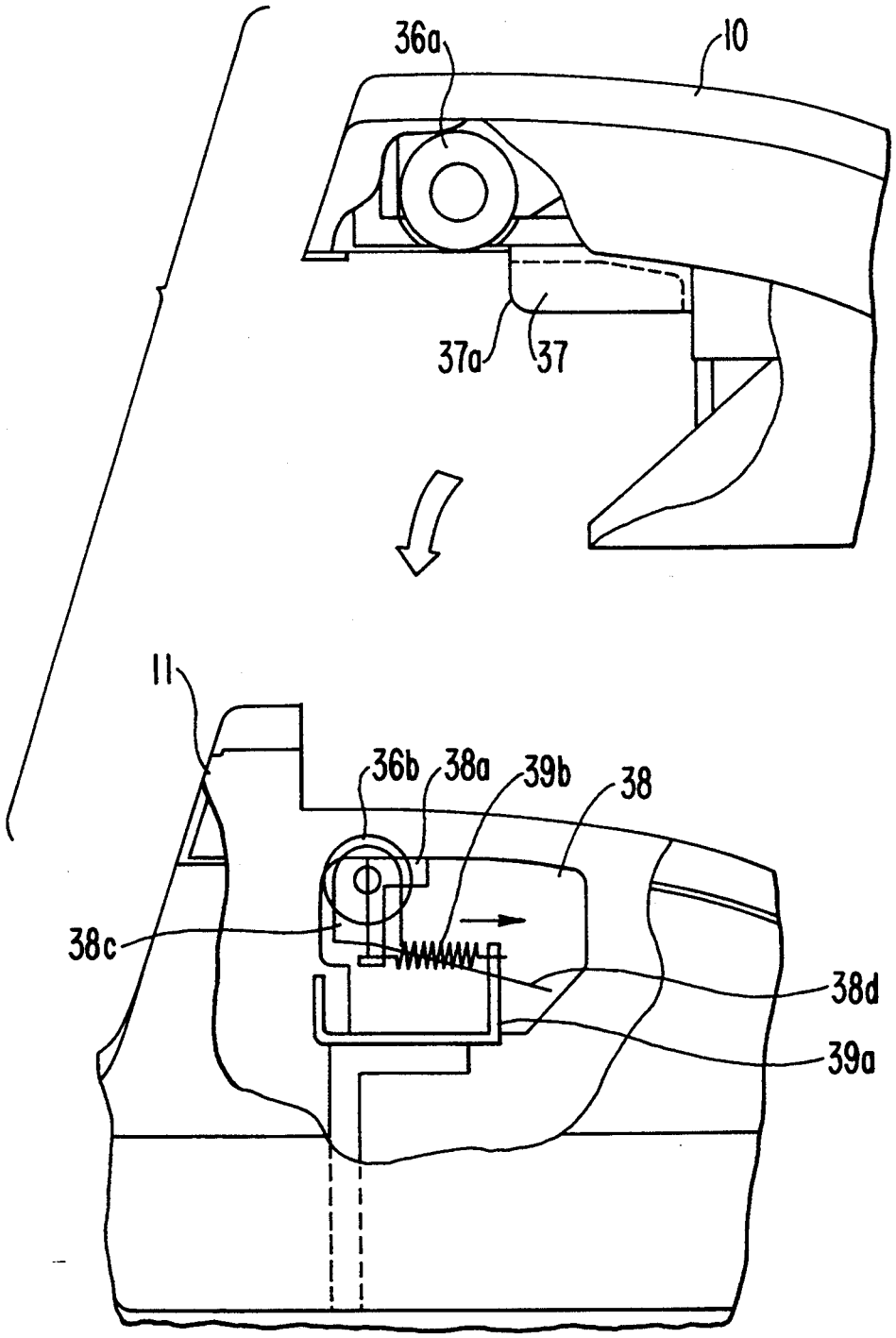
FIG. 9 is a diagram showing the relationship between discharge rollers of the image forming apparatus in FIG. 2.
Figure 10:
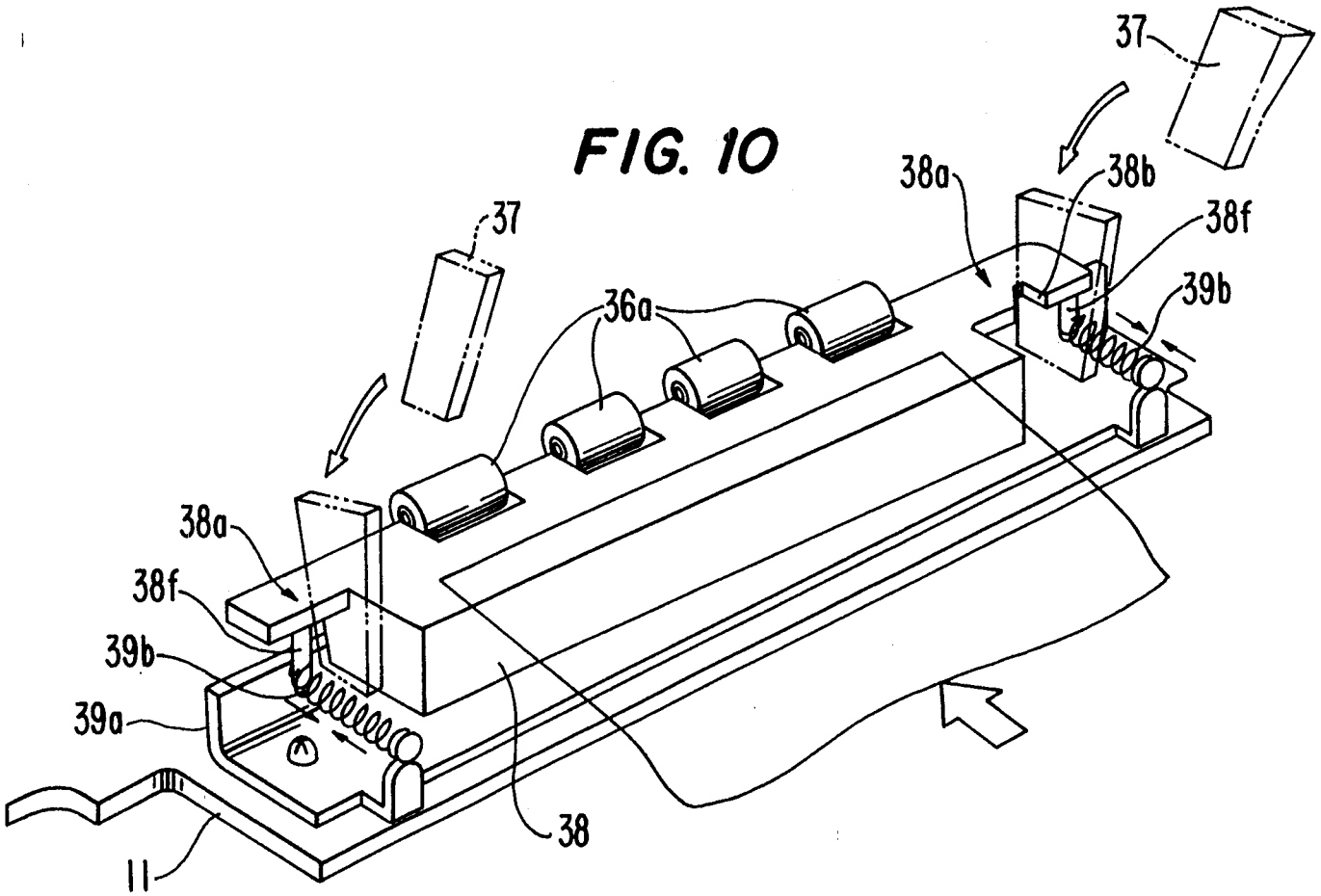
FIG. 10 is a diagram showing the structure of a lower discharge roller unit shown in FIG. 9.
Figure 11A:
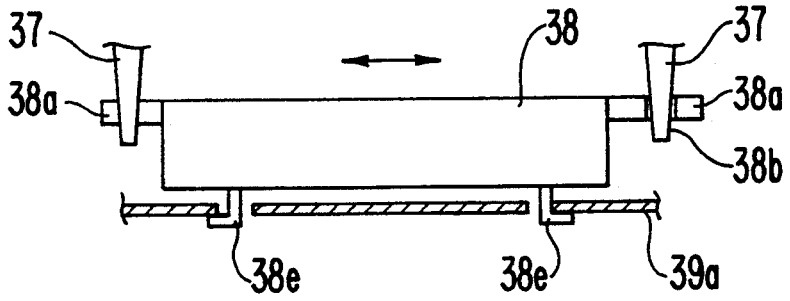
FIGS. 11A and 11B are diagram for explaining the positioning of the discharge rollers.
Figure 11B:
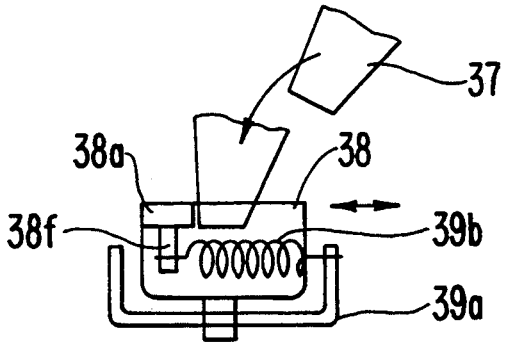
Figure 12:
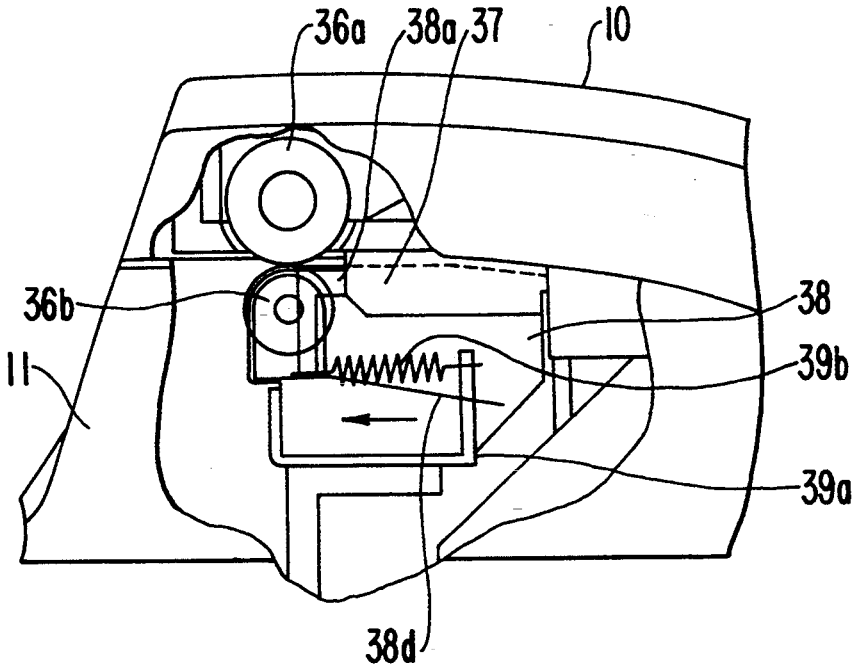
FIG. 12 is a diagram illustrating the front cover closed over the upper cover shown in FIG. 9.

FIG. 9 illustrates the structures of the front cover and upper cover according to one embodiment of this invention, FIG. 10 shows the structure of a pinch roller shown in FIG. 9, FIGS. 11A and 11B illustrate the structure of a pinch roller support block, and FIG. 12 is a diagram illustrating the front cover closed over the upper cover.

Here, a pair of discharge rollers 36*a* and 36*b* are provided separately on the front cover 10 and the upper cover 11 to open the feeding path 3. As the positioning accuracy at the distal ends of the covers 10 and 11 is decreased, some measures should be taken to keep the positioning accuracy of the discharge rollers 36*a* and 36*b*. By opening and closing the covers 10 and 11, the discharge rollers 36*a* and 36*b* may not be positioned properly to face each other, which may feed a sheet askew or may cause paper jamming. It is therefore necessary to provide some means to keep the discharge rollers 36*a* and 36*b* facing each other even the covers 10 and 11 are opened or closed.

In FIG. 9, the discharge roller 36*a* provided on the front cover 10 is a drive roller. This front cover 10 is provided with a pair of positioning ribs 37 on both sides of the discharge roller 36*a*. The positioning ribs 37 each have an inclined portion 37*a*. As shown in FIGS. 9 and 10, the discharge roller 36*b* provided on the upper cover 11 is a pinch roller. Four discharge rollers 36*b* are provided side by side and the rotary shaft of the individual rollers 36*b* is rotatably supported on a support frame 38*c*. This support frame 38*c* is urged upward in FIG. 9 by a leaf spring 38*d* provided on a sheet discharge guide 38. Accordingly, the discharge roller 36*b* is urged upward in the diagram by the leaf spring 38*d* provided on the sheet discharge guide 38.

The sheet discharge guide 38 guides a conveyed sheet at the top surface, and retains the four discharge rollers 36*b* as shown in FIG. 10. Provided at both ends of the sheet discharge guide 38 are anti-climbers 38*a* which engage with the positioning ribs 37 of the front cover 10. The anti-climber 38*a*, disposed at right side of the sheet discharge guide 38, has a V-shaped groove 38*b* formed where the associated positioning rib 37 of the front cover 10 is to be fitted.

As shown in FIG. 11A, this sheet discharge guide 38 is attached to a base 39*a* attached to the upper cover 11 by engaging guides 38*e* in such a way as to be movable sideward, frontward and backward in the diagram. The sheet discharge guide 38 has rods 38*f* provided thereon below the anti-climbers 38*a*. The rods 38*f* are to be connected to coil springs 39*b* provided on the base 39*a*. Accordingly, the sheet discharge guide 38 is urged by the coil springs 39*b* in the direction of the arrow in FIG. 10 with respect to the base 39*a*.

The function of this structure will now be described. As shown in FIG. 9, when the front cover 10 is closed as indicated by the arrow in the diagram with the upper cover 11 closed, the positioning ribs 37 of the front cover 10 push the anti-climbers 38*a* of the sheet discharge guide 38 of the upper cover 11 with the inclined portion 37*a*, as shown in FIGS. 11A and 11B. Consequently, the sheet discharge guide 38 having the discharge rollers 36*b* move leftward in FIG. 11B against the force of the coil springs 39*b* of the base 39*a*.

When the front cover 10 is fully closed over the upper cover 11, the positioning ribs 37 of the front cover 10 abut on the unti-climbers 38*a* of the sheet discharge guide 38, thus positioning the sheet discharge guide 38. As a result, the discharge roller 36*a* of the front cover 10 faces the discharge roller 36*b* of the upper cover 11.

At this time, as shown in FIG. 11A, the sheet discharge guide 38 is provided movable sideward in the diagram by the engaging guides 38*e*, so that the positioning ribs 37 of the front cover 10 are fitted in the V-shaped grooves 38*b* of the unti-climbers 38*a* of the sheet discharge guide 38 of the upper cover 11, thus positioning the right and left positions of the sheet discharge guide 38. Accordingly, the sideward opposing positioning of the discharge roller 36*a* of the front cover 10 and the discharge roller 36*b* of the upper cover 11 can also be secured.

The discharge roller 36b of the upper cover 11 is pressed downward against the force of the leaf spring 38d by the discharge roller 36a of the front cover 10, producing upward force that act on the discharge roller 36a from below. The discharge roller 36b can therefore function as a pinch roller.

Opening the cover 10 can therefore open the space between the discharge rollers 36a and 36b, facilitating removal of a jammed sheet. Even with this opening mechanism, as the discharge roller 36b is not fixed but has a floating structure, the opposing arrangement of the discharge roller 36b with respect to the discharge roller 36a of the cover 10 (positioning and parallelism) can be maintained by closing the cover 10, thus ensuring stable sheet feeding and preventing skewing of sheets and sheet jamming. If the discharge roller 36a on the driving side take a floating structure, the drive transmission system should be made movable, thus complicating the overall structure. In this respect, the discharge roller 36b on the pinch side is given a floating structure to simplify the structure.

As the sheet discharge guide 38 provided with the discharge roller 36b has a floating structure and is also provided with the anti-climbers 38a, positioning can surely be accomplished by the positioning ribs 37 of the front cover 10. What is more, a load on the opening/-closing of the front cover 10 is small.

As both sides of the sheet discharge guide 38 provided with the discharge roller 36b are positioned by the positioning rib pair 37, the parallelism between the discharge rollers 36a and 36b can be prevented from shifting.

Although the process cartridge 2 has been explained as an electrophotographing mechanism which performs charging, exposure and developing operation in the foregoing description, this invention may be applicable to other types of recording systems, such as a electrophotographic system which simultaneously performs the formation of an electrostatic latent image and the developing of this electrostatic latent image or an electrostatic recording system, which transfers a toner image after developing the electrostatic latent image. Further, the sheets are not limited to paper, and other media may be used as well. Although the image forming apparatus has been explained as a printer, it may be a different type of image forming apparatus, such as a copying machine or facsimile. The stationary drive roller 36a is provided on the front cover 10 and the floating pinch roller 36b is provided on the upper cover 11 at the discharging position. Those rollers may be provided reversely. Although the developing unit uses a non-magnetic, one-component developer in the foregoing description, it may use another known type of developer, such as a magnetic, one-component developer or a magnetic, two-component developer.

According to the present invention, since the front of the apparatus is opened by opening the front cover 10 and the space above the process cartridge 2 is opened by opening the upper cover 11, the process cartridge 2 can be pulled out upward, making the exchaning operation easier. As ā large opened space can be secured, the process cartridge 2 can be designed large to increase the amount of a retainable developer, thus extending the exchanging cycle.

What is claimed is:

1. An image forming apparatus, comprising:

an endless latent image carrier;

image forming means for forming an electrostatic latent image on the latent image carrier;

developing means for developing the electrostatic latent image on the latent image carrier;

transfer means for transferring a toner image on the latent image carrier onto a sheet;

fixing means for fixing the toner image on the sheet;

a housing, sheet retaining means provided at a bottom portion of the housing for retaining the sheet;

a process cartridge, provided detachable to the apparatus above the sheet retaining means, for holding at least the latent image carrier and the developing means;

a stacker, provided above the process cartridge, for holding a discharge sheet on which the toner image has been fixed;

a feeding path along which the sheet from the sheet retaining means is discharged on the stacker through the process cartridge;

a front cover provided on the housing rotatable frontward of the apparatus;

an upper cover provided on the housing to be rotatable upward of the apparatus, the stacker being formed in the upper cover;

the front cover provided in such a way that a distal end of the front cover covers that of the upper cover;

a first discharge roller provided at the distal end of the front cover, for discharging the sheet on the stacker;

a second discharge roller provided at the distal end of the upper cover, facing the first discharge roller;

a support block provided on the upper cover said support block having a movable sub-support block for supporting a shaft of the second discharge roller and a spring member for urging the sub-support block toward the first discharge roller; and a positioning member provided on the front cover and engageable with the support bock, for positioning the support block.

2. The image forming apparatus according to claim 1, wherein the support block is a guide member for a sheet to be discharged.

3. The image forming apparatus according to claim 1, wherein the sub-support block is movable in a sheet discharging direction of the second discharge roller.

4. The image forming apparatus according to claim 1, wherein the sub-support block is supported on a base of the upper cover in such a way as to be movable in an axial direction of the second discharge roller.

5. The image forming apparatus according to claim 1, wherein the positioning member of the front cover is constituted of a pair of positioning members; and the support block of the upper cover has a pair of anti-climbers to which the pair of positioning members are to abut.

6. The image forming apparatus according to claim 5, wherein a groove is formed in at least one of the pair of anti-climbers, and one of the positioning members are fitted in the groove.

7. An image forming apparatus, comprising:

an endless latent image carrier;

image forming means for forming an electrostatic latent image on the latent image carrier;

developing means for developing the electrostatic latent image on the latent image carrier;

transfer means for transferring a toner image on the latent image carrier onto a sheet;

fixing means for fixing the toner image on the sheet;

a housing, sheet retaining means provided at a bottom portion of the housing for retaining the sheet;

a process cartridge, provided detachable to the apparatus above the sheet retaining means, for holding at least the latent image carrier and the developing means;

a stacker, provided above the process cartridge, for holding a discharge sheet on which the toner image has been fixed;

a feeding path along which the sheet from the sheet retaining means is discharged on the stacker through the process cartridge;

a front cover provided on the housing rotatable frontward of the apparatus;

an upper cover provided on the housing to be rotatable upward of the apparatus, the stacker being formed in the upper cover;

the front cover provided in such a way that a distal end of the front cover covers that of the upper cover;

a first discharge roller provided at the distal end of the front cover, for discharging the sheet on the stacker;

a second discharge roller provided at the distal end of the upper cover, facing the first discharge roller;

a movable support block provided on the upper cover, for supporting the second discharge roller;

a positioning member provided on the front cover and engageable with the support block, for positioning the support block;

(The image forming apparatus according to claim 4,) and wherein the support block is a guide member for a sheet to be discharged.

8. The image forming apparatus according to claim 7, wherein the support block is movable in a sheet discharging direction of the second discharge roller.

9. The image forming apparatus according to claim 7, wherein the support block is supported on a base of the upper cover in such a way as to be movable in an axial direction of the second discharge roller.

10. The image forming apparatus according to claim 7, wherein the positioning member of the front cover is constituted of a pair of positioning members; and the support block of the upper cover has a pair of anti-climbers to which the pair of positioning members are to abut.

11. The image forming apparatus according to claim 10, wherein a groove is formed in at least one of the pair of anti-climbers, and the positioning members are fitted in the groove.

12. An image forming apparatus, comprising:

an endless latent image carrier;

image forming means for forming an electrostatic latent image on the latent image carrier;

developing means for developing the electrostatic latent image on the latent image carrier;

transfer means for transferring a toner image on the latent image carrier onto a sheet;

fixing means for fixing the toner image on the sheet;

a housing, sheet retaining means provided at a bottom portion of the housing for retaining the sheet;

a process cartridge, provided detachable to the apparatus above the sheet retaining means, for holding at least the latent image carrier and the developing means;

a stacker, provided above the process cartridge, for holding a discharge sheet on which the toner image has been fixed;

a feeding path along which the sheet from the sheet retaining means is discharged on the stacker through the process cartridge;

a front cover provided on the housing rotatable frontward of the apparatus;

an upper cover provided on the housing to be rotatable upward of the apparatus, the stacker being formed in the upper cover;

the front cover provided in such a way that a distal end of the front cover covers that of the upper cover;

a first discharge roller provided at the distal end of the front cover, for discharging the sheet on the stacker;

a second discharge roller provided at the distal end of the upper cover, facing the first discharge roller;

a movable support block provided on the upper cover, for supporting the second discharge roller;

a positioning member provided on the front cover and engageable with the support block, for positioning the support block;

(The image forming apparatus according to claim 4,) and wherein the support block is movable in a sheet discharging direction of the second discharge roller.

13. The image forming apparatus according to claim 12, wherein the support block is supported on a base of the upper cover in such a way as to be movable in an axial direction of the second discharge roller.

14. The image forming apparatus according to claim 12, wherein the positioning member of the front cover is constituted of a pair of positioning members; and the support block of the upper cover has a pair of anti-climbers to which the pair of positioning members are to abut.

15. The image forming apparatus according to claim 14, wherein a groove is formed in at least one of the pair of anti-climbers, and the positioning members are fitted in the groove.

16. An image forming apparatus, comprising:

an endless latent image carrier;

image forming means for forming an electrostatic latent image on the latent image carrier;

developing means for developing the electrostatic latent image on the latent image carrier;

transfer means for transferring a toner image on the latent image carrier onto a sheet;

fixing means for fixing the toner image on the sheet;

a housing, sheet retaining means provided at a bottom portion of the housing for retaining the sheet;

a process cartridge, provided detachable to the apparatus above the sheet retaining means, for holding at least the latent image carrier and the developing means;

a stacker, provided above the process cartridge, for holding a discharge sheet on which the toner image has been fixed;

a feeding path along which the sheet from the sheet retaining means is discharged on the stacker through the process cartridge;

a front cover provided on the housing rotatable frontward of the apparatus;

an upper cover provided on the housing to be rotatable upward of the apparatus, the stacker being formed in the upper cover;

the front cover provided in such a way that a distal end of the front cover covers that of the upper cover;

a first discharge roller provided at the distal end of the front cover, for discharging the sheet on the stacker;

a second discharge roller provided at the distal end of the upper cover, facing the first discharge roller;

a movable support block provided on the upper cover, for supporting the second discharge roller;

a positioning member provided on the front cover and engageable with the support block, for positioning the support block;

(The image forming apparatus according to claim 4,) and wherein the support block is supported on a base of the upper cover in such a way as to be movable in an axial direction of the second discharge roller.

17. The image forming apparatus according to claim 16, wherein the positioning member of the front cover is constituted of a pair of positioning members; and the support block of the upper cover has a pair of anti-climbers to which the pair of positioning members are to abut.

18. The image forming apparatus according to claim 17, wherein a groove is formed in at least one of the pair of anti-climbers, and the positioning members are fitted in the groove.

19. An image forming apparatus, comprising:

an endless latent image carrier;

image forming means for forming an electrostatic latent image on the latent image carrier;

developing means for developing the electrostatic latent image on the latent image carrier;

transfer means for transferring a toner image on the latent image carrier onto a sheet;

fixing means for fixing the toner image on the sheet;

a housing, sheet retaining means provided at a bottom portion of the housing for retaining the sheet;

a process cartridge, provided detachable to the apparatus above the sheet retaining means, for holding at least the latent image carrier and the developing means;

a stacker, provided above the process cartridge, for holding a discharge sheet on which the toner image has been fixed;

a feeding path along which the sheet from the sheet retaining means is discharged on the stacker through the process cartridge;

a front cover provided on the housing rotatable frontward of the apparatus;

an upper cover provided on the housing to be rotatable upward of the apparatus, the stacker being formed in the upper cover;

the front cover provided in such a way that a distal end of the front cover covers that of the upper cover;

a first discharge roller provided at the distal end of the front cover, for discharging the sheet on the stacker;

a second discharge roller provided at the distal end of the upper cover, facing the first discharge roller;

a movable support block provided on the upper cover, for supporting the second discharge roller;

a positioning member provided on the front cover and engageable with the support block, for positioning the support block;

(The image forming apparatus according to claim 4,) and wherein the positioning member of the front cover is constituted of a pair of positioning members; and the support block of the upper cover has a pair of anti-climbers to which the pair of positioning members are to abut.

20. The image forming apparatus according to claim 19, wherein a groove is formed in at least one of the pair of anti-climbers, and the positioning members are fitted in the groove.

21. An image forming apparatus, comprising:

an endless latent image carrier;

image forming means for forming an electrostatic latent image on the latent image carrier;

developing means for developing the electrostatic latent image on the latent image carrier;

transfer means for transferring a toner image on the latent image carrier onto a sheet;

fixing means for fixing the toner image on the sheet;

a housing, sheet retaining means provided at a bottom portion of the housing for retaining the sheet;

a process cartridge, provided detachable to the apparatus above the sheet retaining means, for holding at least the latent image carrier and the developing means;

a stacker, provided above the process cartridge, for holding a discharged sheet on which the toner image has been fixed;

a feeding path along which the sheet from the sheet retaining means is discharged on the stacker through the process cartridge;

a front cover provided on the housing to be rotatable frontward of the apparatus;

an upper cover provided on the housing to be rotatable upward of the apparatus, the stacker being formed in the upper cover;

a driver roller provided at a distal end of the front cover, for discharging the sheet on the stacker;

a pinch roller provided at a distal end of the upper cover, facing the driver roller;

a movable support block provided on the upper cover, for supporting the pinch roller; and a positioning member provided on the front cover and engageable with the support block, for positioning the support block.

* * * * *